United States Patent [19]

Davis et al.

[11] Patent Number: 4,668,928

[45] Date of Patent: May 26, 1987

[54] BI-STABLE SWITCH WITH PIVOTED ARMATURE

[75] Inventors: Brent M. Davis, Beaverton; Frederick J. Beckett, Portland; Raymond A. Zandonatti, Beaverton, all of Oreg.

[73] Assignee: Tektronix, Inc., Beaverton, Oreg.

[21] Appl. No.: 877,081

[22] Filed: Jun. 23, 1986

[51] Int. Cl.[4] ..... H01H 51/22

[52] U.S. Cl. ..... 335/79; 335/80; 335/234

[58] Field of Search ..... 335/78, 79, 80, 81, 335/83, 229, 230, 234

[56] References Cited

U.S. PATENT DOCUMENTS

| | | | |
|---|---|---|---|
| 2,632,072 | 3/1953 | Zellner | 335/78 |
| 3,906,416 | 9/1975 | Sprando | 335/80 |
| 3,946,347 | 3/1976 | Sauer | 335/78 X |
| 4,543,550 | 9/1985 | Sauer | 335/81 X |

*Primary Examiner*—George Harris

*Attorney, Agent, or Firm*—John Smith-Hill; George T. Noe

[57] ABSTRACT

A switch device comprises a support member having at least first and second stationary contacts thereon. An armature is mounted on the support member by means of a body of elastomeric material that is attached to both the support member and the armature. Deformation of the body of elastomeric material allows the armature to pivot relative to the support member between a first position in which electrically-conductive material of the armature establishes electrically conductive connection between the stationary contacts and a second position in which the armature is spaced from at least one of the contacts. At least one permanent magnet is carried by the armature. An electrically-driven switch actuator is mounted stationarily relative to the support member and has first and second energization states. In the first energization state, magnetic material of the switch actuator is in magnetically-coupled relationship with the permanent magnet and a force is produced that causes the armature to assume a selected one of its first and second positions. In the second energization state, a force is produced that causes the armature to assume the other of its first and second positions.

14 Claims, 4 Drawing Figures

BI-STABLE SWITCH WITH PIVOTED ARMATURE

BACKGROUND OF THE INVENTION

Relay switches having physically movable contact elements are used in many different applications. In particular, it is common to use a relay switch having physically movable contact elements in order to switch resistors and/or capacitors into or out of an attenuator network, in order to vary the effective attenuation factor of the network. However, since movable contact elements are used, there is the possibility of contamination degrading the electrical contact provided by a relay switch. It is therefore desirable that such a relay switch be hermetically sealed to prevent contamination. However, sealing generally makes actuation of the relay switch difficult.

It is well known to use magnetic forces for bringing about movement of the contact element of a relay switch. In one kind of relay switch, the contact element is carried by an armature that also carries a permanent magnet. The armature is mounted on a support member so as to be pivotable about an axis that lies between the North and South poles of the permanent magnet between two end positions. In a first of these end positions, the North pole of the permanent magnet is at a minimum distance from the support member and the South pole is at a maximum distance, and vice versa in the second end position. Two small bodies of thermal compensation material are positioned on the support member, so as to be as close as possible to the North and South poles respectively. An electrical resistance heater is in thermally-conductive contact with each body of thermal compensation material. The thermal compensation material is a soft ferromagnetic material at room temperature (about 18 degrees C.) and upon heating above its Curie point (about 85 degrees C.) the thermal compensation material changes from being ferromagnetic to diamagnetic. In a first stable state of this known relay switch, the armature is in its first end position and so the North pole of the permanent magnet is at a minimum distance from its associated body of thermal compensation material and the South pole is at a maximum distance, and in a second stable state the armature is in its second end position and the North and South poles are at maximum and minimum distances respectively from the associated bodies of thermal compensation material. So long as the two bodies of thermal compensation material remain ferromagnetic, the switch remains in its first or second stable state. If the switch is in its first stable state, and the body of thermal compensation material associated with the North pole is heated above its Curie point, the attraction of the South pole to its associated body of thermal compensation material overcomes the attraction of the North pole, and the switch will toggle to its second stable state. The switch can then be returned from its second stable state to its first stable state by heating the body of thermal compensation material associated with the South pole.

In this known thermomagnetic relay switch, the armature is mounted to the support member by means of a pivot mechanism having two rigid elements that undergo relative rotational movement when the armature pivots from one stable state to the other stable state. Friction and stiction between the two rigid elements affect the mechanical properties of the pivot mechanism.

U.S. Pat. No. 4,150,420 discloses a cam-actuated switch comprising a metal contact element bonded to a body of elastomeric material. The body of elastomeric material is carried by a cam follower that is mounted in cantilever fashion to a circuit board. A rotatable cam engages the cam follower, and during the dwell of the cam the metal contact element is pressed into contact with two conductor runs of the circuit board and establishes electrical connection between these conductor runs. This type of switch has good high frequency electrical performance, but suffers from the disadvantage that it is necessary to rotate the cam in order to actuate the switch.

SUMMARY OF THE INVENTION

In accordance with a first aspect of the invention, a switch device comprises a support member having at least first and second stationary contacts thereon. An armature is mounted on the support member by means of a body of elastomeric material that is attached to both the support member and the armature. Deformation of the body of elastomeric material allows the armature to pivot relative to the support member between a first position in which it establishes electrically conductive connection between the stationary contacts and a second position in which it is spaced from at least one of the contacts. At least one permanent magnet is carried by the armature. An electrically-driven switch actuator is mounted stationarily relative to the support member and has first and second energization states. In the first energization state, magnetic material of the switch actuator is in magnetically-coupled relationship with the permanent magnet and a force is produced that causes the armature to assume a selected one of its first and second positions. In the second energization state, a force is produced that causes the armature to assume the other of its first and second positions.

In accordance with a second aspect of the present invention there is provided a switch device comprising a support member having at least first and second stationary contacts thereon, and an armature mounted on the support member and movable relative to the support member between a first position and a second position. At least one permanent magnet is carried by the armature. An electrically-driven switch actuator is mounted stationarily relative to the support member and has first and second energization states. In the first energization state, magnetic material of the switch actuator is in magnetically-coupled relationship with the permanent magnet and a force is produced that causes the armature to assume a selected one of its first and second positions. In the second energization state, a force is produced that causes the armature to assume its second position. The armature includes a body of elastomeric material having a surface to which electrically conductive material is bonded. In the first position of the armature, the conductive material establishes electrically conductive connection between the stationary contacts of the support member and in the second position the conductive material is spaced from at least one of the contacts.

BRIEF DESCRIPTION OF THE DRAWINGS

For a better understanding of the invention, and to show how the same may be carried into effect, reference will now be made, by way of example, to the accompanying drawings in which.

Figure 1:
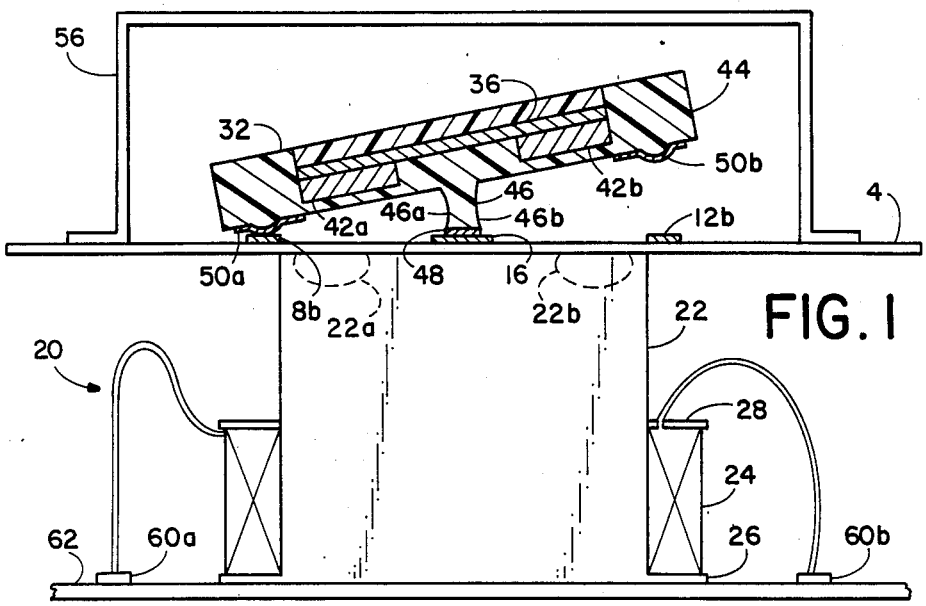
FIG. 1 is a diagrammatic sectional view of a first switch device embodying the present invention.

In the drawings, relative dimensions have been distorted in order to aid the showing of important features of the switch device.

DETAILED DESCRIPTION

Figure 2:
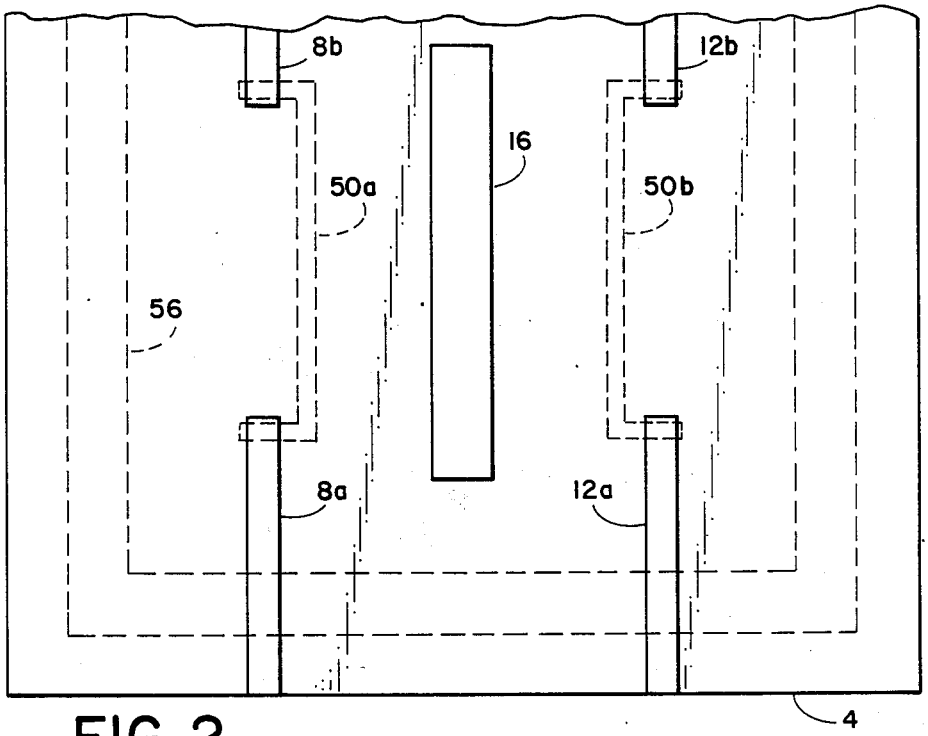
FIG. 2 is a top plan view of a component of the FIG. 1 switch device.

The switch device illustrated in FIGS. 1 and 2 comprises a substrate 4 of dielectric material, such as polyimide, that has conductor runs 8*a*, 8*b*, 12*a* and 12*b*, for example of gold-plated copper, formed thereon. The terminal areas of the four conductor runs are disposed in a substantially square array on the upper surface of the substrate 4. Between the conductor runs 8 and 12 is a metallic strip 16. The strip 16 also is formed of gold-plated copper, and is formed at the same time as the runs 8 and 12.

An electromagnet 20 comprising a core 22 and a winding 24 is attached to the underside of the substrate 4, for example through use of a layer of adhesive material (not shown) between the upper end face of the core 22 and the lower surface of the substrate 4. The winding 24 is accommodated between a flange 26 of the core and an annulus 28 that is fitted over the core with an interference fit.

The switch device further comprises an armature 32. The armature comprises a square plate 36 of soft iron. Two strip-form permanent magnets 42*a* and 42*b* are attached to the plate 36 along two opposite edges of the plate. The permanent magnets are magnetized in the direction perpendicular to their main faces, and the magnet 42*a* has its North pole down while the magnet 42*b* has its North pole up. The plate 36 and the magnets 42 are encased in a body 44 of elastomeric material. The body 44 is formed by injection molding in a die that is shaped to provide a recess within the body 44, and the plate 36, having the magnets 42 attached thereto, is inserted into the recess. A body of epoxy material is then cast into the aperture defining the entrance to the recess, in order to retain the permanent magnet structure in the recess.

The body 44 includes a ridge 46 that projects in the direction away from the plate 36. The ridge is generally rectangular in cross-section, but is slightly waisted at its two opposite sides 46*a* and 46*b*.

Strips 48, 50*a* and 50*b* of metal are bonded to the body 44 along the ridge and along the two opposite edge regions of the body that lie parallel to the ridge. The strips are bonded to the body 44 during molding of the body 44, in the manner described in U.S. Pat. No. 4,150,420.

The strip 48 is attached to the strip 16, e.g. by means of epoxy adhesive material or reflow soldering, and the body 44 is thereby attached to the substrate. The ridge 46 then forms an elastomeric hinge that allows the armature to pivot relative to the substrate between two opposite end positions.

If the armature is initially in the position shown in FIG. 1, the strip 50*a* provides electrical contact between the conductor runs 8*a* and 8*b* and the conductor runs 12*a* and 12*b* are mutually electrically isolated. The ridge 46 is compressed at its side 46*a*. The downward-facing North pole of the magnet 42*a* induces South pole magnetic gradients in the domains of the region 22*a* of the core 22. (The domains in the region 22*b* are not polarized so strongly as those in the region 22*a*.) If the winding 24 is then energized so that it induces a North pole at the upper end of the core 22 and a South pole at the lower end of the core, the domains in the region 22*b* are gradiently polarized more North and the magnet 42*b* is attracted towards the electromagnet 20. The ridge 46 is compressed at its side 46*b*. Initially, the magnet 42*a* is not repelled, because the domains in the region 22*a* are not immediately reversed in polarity. Accordingly, both magnets 42*a* and 42*b* are initially attracted towards the core 22, and the ridge 46 is compressed. As the current in the winding 24 builds up, the induced magnetic polarization of the domains of the region 22*a* is reversed, and the magnet 42*a* is repelled. Compressive stress in the ridge 46 on the side 46*a* is released, and the repulsion of the magnet 42*a* and attraction of the magnet 42*b* act together to transfer the armature to its opposite end position. The contact element 50*b* provides electrical contact between the conductor runs 12*a* and 12*b* and the connection between the conductor runs 8*a* and 8*b* is broken. When the winding 24 is energized in the opposite sense, the armature 32 pivots back to the position shown in FIG. 1.

Because the ridge 46 is compressed before the armature transfers, and release of the compression assists the transfer, the current required to transfer the armature is less than would be required if a pivot composed of rigid components and defining a stationary pivot axis were employed.

When the armature has been transferred from one of its end positions to its opposite end position, the current in the winding 24 may be discontinued, and the armature will be retained in position by local attraction of whichever permanent magnet is closer to the core 22. The armature is therefore bistable, or latching.

A ceramic lid 56 is attached to the upper surface of the substrate 4 using an epoxy adhesive or solder, and the armature 32 and the terminal areas of the conductors runs 8 and 12 are thereby isolated from the ambient atmosphere. Contamination of the terminal areas of the conductor runs and of the contact strips 50*a* and 50*b*, and consequent degradation of the electrical characteristics of the switch, is thereby prevented. The electromagnet 20 is encapsulated in a body of potting material (not shown) in order to protect it from the ambient atmosphere. The terminations of the winding 24 are connected to conductor runs 60*a* and 60*b* defined on the upper surface of a secondary substrate 62. The conductor runs 8 and 12 are exposed about the periphery of the lid 56, and are connected by solder to metallized strips (not shown) on the ceramic lid. (Of course, if the lid 56 is attached to the substrate 4 using solder, it is necessary to isolate the conductor runs 8 and 12 electrically from the solder.) The switch device may then be mounted on a conventional circuit board and connections made to the conductor runs 8 and 12 through the metallized strips.

Figure 3:
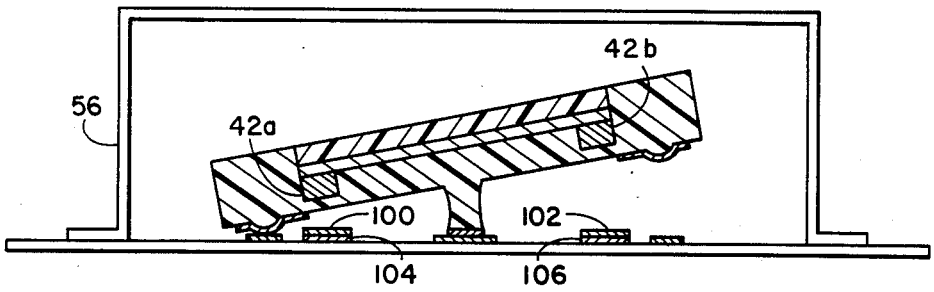
FIG. 3 is a view similar to FIG. 1 of a second switch device embodying the present invention.
Figure 4:
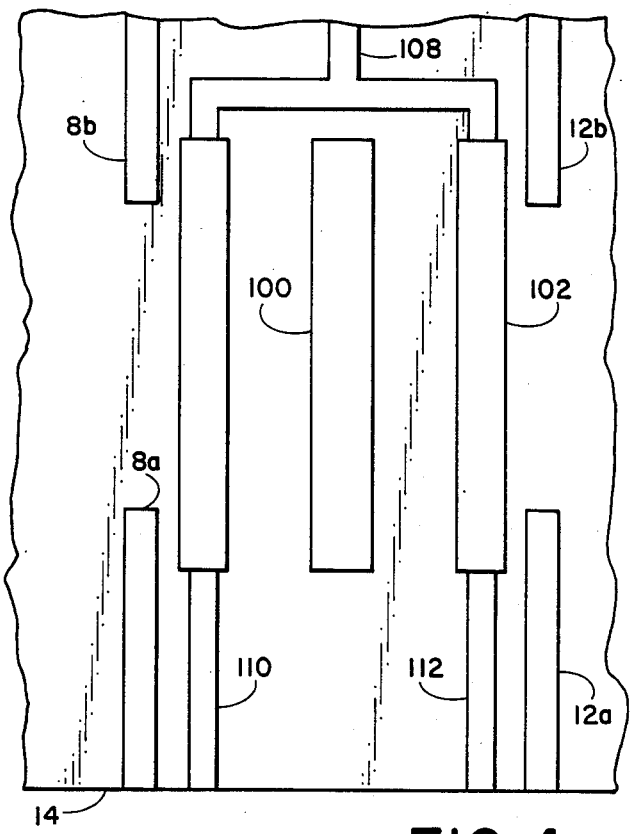
FIG. 4 is a top plan view of a component of the FIG. 3 switch device.

In the case of the modification illustrated in FIGS. 3 and 4, keeper strips 100 and 102 of thermal compensation material are provided on the upper surface of the substrate on opposite sides of the strip 16. The strips of thermal compensation material lie over respective thick film electrical resistance heaters 104 and 106. At normal room temperature (about 18 degrees C.), the bodies of thermal compensation material are ferromagnetic and the armature assumes one of its end positions, e.g., the position shown in FIG. 3. If then the heater 104 is energized briefly, the strip 100 becomes paramagnetic and the coupling between the magnet 42*a* and the strip 100 is weakened. The magnetic coupling of the magnet 42*b* and the strip 102 thereupon pivots the armature to its opposite end position, and the armature will remain in that position when supply of current to the heater 104 is discontinued.

As in the case of FIGS. 1 and 2, a ceramic lid 56 is attached to the upper surface of the substrate 4 in order to isolate the armature and the terminal areas of the conductor runs from the ambient atmosphere. The conductor runs 8, 12, 108, 110 and 112 are exposed about the periphery of the lid, and are connected by solder to metallized strips (not shown) on the ceramic lid. The switch device may then be mounted on a conventional circuit board and connections made to the heaters 104 and 106 and the conductor runs 8 and 12 through the metallized strips.

It will be appreciated that the present invention is not restricted to the particular switch devices that have been described and illustrated, and that variations may be made therein without departing from the scope of the invention as defined in the appended claims and equivalents thereof. For example, in the case of the FIG. 1 switch device the electromagnet may be positioned above the lid 56 instead of below the substrate 4. It is necessary only that the magnetic field established by the electromagnet be substantially symmetrical about a plane that is perpendicular to the plane of symmetry of the two end positions of the armature. Similarly, in the case of FIGS. 3 and 4 the keeper strips 100, 102 and the associated heaters 104, 106 may be provided on the lid 56 instead of on the substrate 4.

We claim:

1. A switch device comprising a support member having at least first and second stationary contacts thereon, an armature, a body of elastomeric material that is attached to both the support member and the armature and allows pivotal movement of the armature relative to the support member between a first position in which the armature establishes electrically conductive connection between the stationary contacts and a second position in which it is spaced from at least one of the contacts, and the switch device further comprising permanent magnet means carried by the armature, and an electrically-driven switch actuator mounted stationarily relative to the support member and having first and second energization states, the switch actuator including magnetic material that, in the first energization state of the switch actuator, is in magnetically-coupled relationship with the permanent magnet means whereby a force is produced that causes the magnet to assume a selected one of its first and second positions, whereas when the switch actuator is in its second energization state a force is produced that causes the armature to assume the other of its first and second positions.

2. A switch device according to claim 1, wherein the elastomeric material is dielectric and the body of elastomeric material has a surface portion to which electrically conductive material is bonded, the conductive material establishing electrically conductive connection between the stationary contacts of the support member when the armature is in its first position and being spaced from at least one of the stationary contacts when the armature is in its second position.

3. A switch device according to claim 2, wherein the conductive material comprises a strip of metal adhered to the body of elastomeric material, the strip of metal being in electrically conductive contact with the first and second stationary contacts when the armature is in its first position and being spaced from the first and second stationary contacts when the armature is in its second position.

4. A switch device according to claim 1, wherein the electrically-driven switch actuator comprising an electromagnet that, in each of the energization states, establishes a magnetic field that is at least partially symmetrical about the axis of pivotal movement of the armature, the magnetic field established in the first energization state being of opposite polarity from that established in the second energization state.

5. A switch device according to claim 1, wherein the support member has third and fourth stationary contacts thereon and the armature establishes electrically conductive contact between the third and fourth stationary contacts when it is in the second position and is spaced from at least one of the third and fourth contacts when it is in the first position.

6. A switch device according to claim 5, wherein elastomeric material is dielectric and the the body of elastomeric material has two opposite edge regions that are substantially parallel to and substantially equidistant from the axis of pivotal movement of the armature, and the armature also comprises two strips of conductive material carried by the body of elastomeric material along the two opposite edge regions respectively, one strip of conductive material being in electrically conductive contact with the first and second stationary contacts and the other strip of conductive material being spaced from the third and fourth stationary contacts when the armature is in its first position, and said one strip being spaced from the first and second stationary contacts and said other strip being in electrically conductive contact with the third and fourth contacts when the armature is in its second position.

7. A switch device according to claim 1, wherein the switch actuator comprises first and second bodies of thermal compensation materials mounted on the support member and first and second heaters in thermally-conductive contact with the bodies of thermal compensation material respectively, the bodies of thermal compensation material being positioned so that when the armature is in its first position a magnetic circuit of low reluctance is established through the permanent magnet means and the first body of thermal compensation material and a magnetic circuit of high reluctance is established through the permanent magnet means and the second body of thermal compensation material, and when the armature is in its second position the magnetic circuit through the first body of thermal compensation material has a high reluctance and that through the second body of thermal compensation material has a low reluctance.

8. A switch device comprising a support member having at least first and second stationary contacts thereon, an armature mounted on the support member and movable relative to the support member between a first position and a second position, permanent magnet means carried by the armature, an electrically-driven switch actuator mounted stationarily relative to the support member and having first and second energization states, the switch actuator including magnetic material that, in the first energization state, is in magnetically-coupled relationship with the permanent magnet means whereby a force is produced that cause the magnet to assume a selected one of the first and second positions, whereas when the switch actuator is in its second energization state a force is produced that causes the armature to assume the other of its first and second positions, the armature including a body of elastomeric material having a surface to which electrically conductive material is bonded, the conductive material establishing electrically conductive connection between the stationary contacts of the support member when the armature is in the first position and being spaced from at least one of the contacts when the armature is in the second position.

9. A switch device according to claim 8, wherein the conductive material is in the form of a strip, the strip of conductive material being in electrically conductive contact with the first and second stationary contacts when the armature is in the first position and being spaced from the first and second stationary contacts when the armature is in its second position.

10. A switch device according to claim 8, wherein the support member has third and fourth stationary contacts thereon and the armature establishes electrically conductive contact between the third and fourth stationary contacts when it is in the second position and is spaced from at least on of the third and fourth contacts when it is in the first position.

11. A switch device according to claim 10, wherein the armature is pivotable relative to the support member between said first and second positions, and the body of elastomeric material has two opposite edge regions that are substantially parallel to and substantially equidistant from the axis of pivotal movement of the armature, and the armature also comprises two strips of electrically conductive material that are bonded to the body of elastomeric material along the two opposite edge regions respectively, one strip of conductive material being in electrically conductive contact with the first and second stationary contacts and the other strip of conductive material being spaced from the third and fourth stationary contacts when the armature is in its first position, and said one strip being spaced from the first and second stationary contact and said other strip being in electrically conductive contact with the third and fourth contacts when the armature is in its second position.

12. A switch device according to claim 8, wherein the armature is pivotable relative to the support member between said first and second positions.

13. A switch device according to claim 12, wherein the electrically-driven switch actuator comprising an electromagnet that, in each of the energization states, establishes a magnetic field that is at least partially symmetrical about the axis of pivotal movement of the armature, the magnetic field established in the first energization state being of opposite polarity from that established in the second energization state.

14. A switch device according to claim 8, wherein the switch actuator comprises first and second bodies of thermal compensation materials mounted on the support member and first and second heaters in thermally-conductive contact with the bodies of thermal compensation material respectively, the bodies of thermal compensation material being positioned so that when the armature is in its first position a magnetic circuit of low reluctance is established through the permanent magnet means and the first body of thermal compensation material and a magnetic circuit of high reluctance is established through the permanent magnet means and the second body of thermal compensation material, and when the armature is in its second position the magnetic circuit through the first body of thermal compensation material has a high reluctance and that through the second body of thermal compensation material has a low reluctance.

* * * * *